US012270211B2

(12) United States Patent
Holmboe, Jr.

(10) Patent No.: US 12,270,211 B2
(45) Date of Patent: Apr. 8, 2025

(54) COLUMN FORMING SYSTEM

(71) Applicant: Ellis Formwork Manufacturing, LLC, Oklahoma City, OK (US)

(72) Inventor: James A. Holmboe, Jr., Edmond, OK (US)

(73) Assignee: Ellis Formwork Manufacturing, LLC, Oklahoma City, OK (US)

( * ) Notice: Subject to any disclaimer, the term of this patent is extended or adjusted under 35 U.S.C. 154(b) by 872 days.

(21) Appl. No.: 17/238,990

(22) Filed: Apr. 23, 2021

(65) Prior Publication Data

US 2022/0341194 A1 Oct. 27, 2022

(51) Int. Cl.
*E04G 13/00* (2006.01)
*E04G 13/02* (2006.01)
*E04G 17/00* (2006.01)

(52) U.S. Cl.
CPC ..... *E04G 13/023* (2013.01); *E04G 17/001* (2013.01)

(58) Field of Classification Search
CPC ..... E04G 13/00; E04G 13/02; E04G 13/023; E04G 13/026; E04G 17/00; E04G 17/001; E04G 17/002; E04G 17/004
See application file for complete search history.

(56) References Cited

U.S. PATENT DOCUMENTS 3,357,673 A 12/1967 Williams
4,183,497 A 1/1980 Tamez
4,424,951 A * 1/1984 Spencer ..... E04G 13/021 425/441
4,666,643 A * 5/1987 Spencer ..... E04G 13/02 264/32
4,958,800 A 9/1990 Carlson
4,978,099 A * 12/1990 Carlson ..... E04G 13/02 249/193
5,044,601 A * 9/1991 Miller ..... E04G 17/001 249/47
5,616,271 A 4/1997 Podgurski
5,975,790 A 11/1999 Nogami
6,419,204 B1 * 7/2002 Flathau ..... E04G 17/004 249/47
6,676,102 B1 * 1/2004 Hambelton ..... E04G 13/023 249/189
6,865,859 B2 3/2005 Flathau
7,018,138 B2 * 3/2006 Bae ..... E02D 23/00 52/745.18
8,919,728 B2 * 12/2014 Ludwig ..... E02D 27/016 52/742.14
9,068,363 B2 * 6/2015 Rojas Pimiento .... E04G 13/025
9,534,381 B2 1/2017 Hiscock et al.
10,619,321 B2 * 4/2020 Hess ..... E02B 17/0034
2002/0195536 A1 * 12/2002 Flathau ..... E04G 13/026 249/48
2016/0340899 A1 * 11/2016 Piccone ..... E04B 2/86
2019/0383044 A1 * 12/2019 Johnson ..... E04G 13/02

* cited by examiner

*Primary Examiner* — Chi Q Nguyen
(74) *Attorney, Agent, or Firm* — McAfee & Taft

(57) ABSTRACT

A column forming system for creating chamfer corners and allowing efficient movement from one column location to the next. The column forming system comprises a plurality of formwork panels, a hinge corner bracket moveable between an open and a closed position, and a plurality of corner brackets. The connection of the components allows for the manipulation of the formwork panels relative to one another. A closed position of the hinge corner bracket results in the column forming system defining a column interior.

18 Claims, 9 Drawing Sheets

COLUMN FORMING SYSTEM

TECHNICAL FIELD

The present disclosure relates generally to a column forming system, and, more particularly, to an improved column forming system for the creation of chamfered corners.

BACKGROUND

In the construction industry, column forming systems are known to provide the capability to pour-in-place concrete columns on-site. Column forming systems typically include three or more formwork panels, corner brackets, and an attachment system for attaching the formwork panels to the corner brackets to form the column shape. Current column forming systems include rigid corner brackets such that, when the concrete has cured, two or more of the corner brackets must be disconnected from the formwork panels to allow for the column forming system to be removed and taken to the next column location. Removing the corner brackets, and then having to reconnect them in the new column location, can be time consuming. In addition, column forming systems typically create ninety-degree corner angles which have sharp edges once the concrete cures. Thus, it is desirous to create chamfer corners to remove the sharp edges as a safety precaution, allow for easier removal of the formwork panels from the cured concrete columns, create aesthetic appeal, and make it easier to fill the interior of the column forming system, i.e. sharp corners tend to be tougher to completely fill with concrete than chamfer corners. Typically, to create chamfer corners, an additional device is inserted between the corner bracket and the interior of the column forming system or an additional attachment to the corner bracket is used. These deficiencies prompt the need for a column forming system having a corner bracket that creates chamfer corners and allows the column forming system to be easily moved from one column location to the next.

SUMMARY

In accordance with the present invention, a column forming system is provided which overcomes the deficiencies described above, and has other advantages.

In one embodiment, a column forming system is provided. The column forming system comprises a first formwork panel having a first edge and a second edge, a second formwork panel having a first edge and a second edge, a third formwork panel having a first edge and a second edge, a hinge corner bracket, a first corner bracket, and a second corner bracket. The hinge corner bracket has a first rail and a second rail and is moveable between an open position and a closed position. The first rail is attached to the second edge of the first formwork panel and the second rail is attached to the first edge of the second formwork panel. In the closed position, the hinge corner bracket forms a hinge chamfered panel extending between the first formwork panel and the second formwork panel.

The first corner bracket has a first rail, a second rail, and a first chamfered panel extending between the first rail and the second rail. The first rail is attached to the second edge of the second formwork panel and the second rail is attached to the first edge of the third formwork panel such that the first chamfered panel extends between the second formwork panel and the third formwork panel. The second corner bracket has a first rail, a second rail, and a second chamfered panel extending between the first rail and the second rail. The first rail is attached to the second edge of the third formwork panel. The open position of the hinge corner bracket is configured to allow manipulation of the first formwork panel, the second formwork panel, and the third formwork panel relative to one another. When the hinge corner bracket is in the closed position, the column forming system defines a column interior.

Another disclosed embodiment provides a method of forming a concrete column. The method comprises the steps of: attaching a first rail of a hinge corner bracket to a second edge of a first formwork panel, the hinge corner bracket moveable between an open position and a closed position; attaching a second rail of the hinge corner bracket to a first edge of a second formwork panel such that when the hinge corner bracket is in the closed position a hinge chamfered panel extends between the first formwork panel and the second formwork panel; and performing the following attachment steps: (i) attaching a first rail of a first corner bracket to a second edge of the second formwork panel; (ii) attaching a second rail of the first corner bracket to a first edge of a third formwork panel such that a first chamfered panel extends between the second formwork panel and the third formwork panel; (iii) attaching a first rail of a second corner bracket to a second edge of the third formwork panel; (iv) attaching a second rail of the second corner bracket to a first edge of a fourth formwork panel such that a second chamfered panel extends between the third formwork panel and the fourth formwork panel; (v) attaching a first rail of a third corner bracket to a second edge of the fourth formwork panel; (vi) attaching a second rail of the third corner bracket to a first edge of the first formwork panel such that a third chamfered panel extends between the fourth formwork panel and the first formwork panel; moving the hinge corner bracket into the closed position, wherein one of attachment steps (i)-(vi) occurs after the hinge corner bracket is moved to the closed position so as to create a column forming system which defines a column interior; introducing a cementitious material into the column interior; allowing the cementitious material to cure into a cementitious column; detaching one of either the first rail or the second rail of one of the first corner bracket, second corner bracket or third corner bracket; moving the hinge corner bracket into the open position allowing manipulation of the first formwork panel, the second formwork panel, the third formwork panel, and the fourth formwork panel relative to one another; and manipulating the first formwork panel, the second formwork panel, the third formwork panel, and the fourth formwork panel relative to one another such that the column forming system can be removed to expose the cementitious column and moved to a new location.

BRIEF DESCRIPTION OF THE DRAWINGS

The drawings included with this application illustrate certain aspects of the embodiments described herein. However, the drawings should not be viewed as exclusive embodiments.

FIG. 6 is a top view of a corner bracket in accordance with one embodiment of the present disclosure.

DETAILED DESCRIPTION

Figure 1:
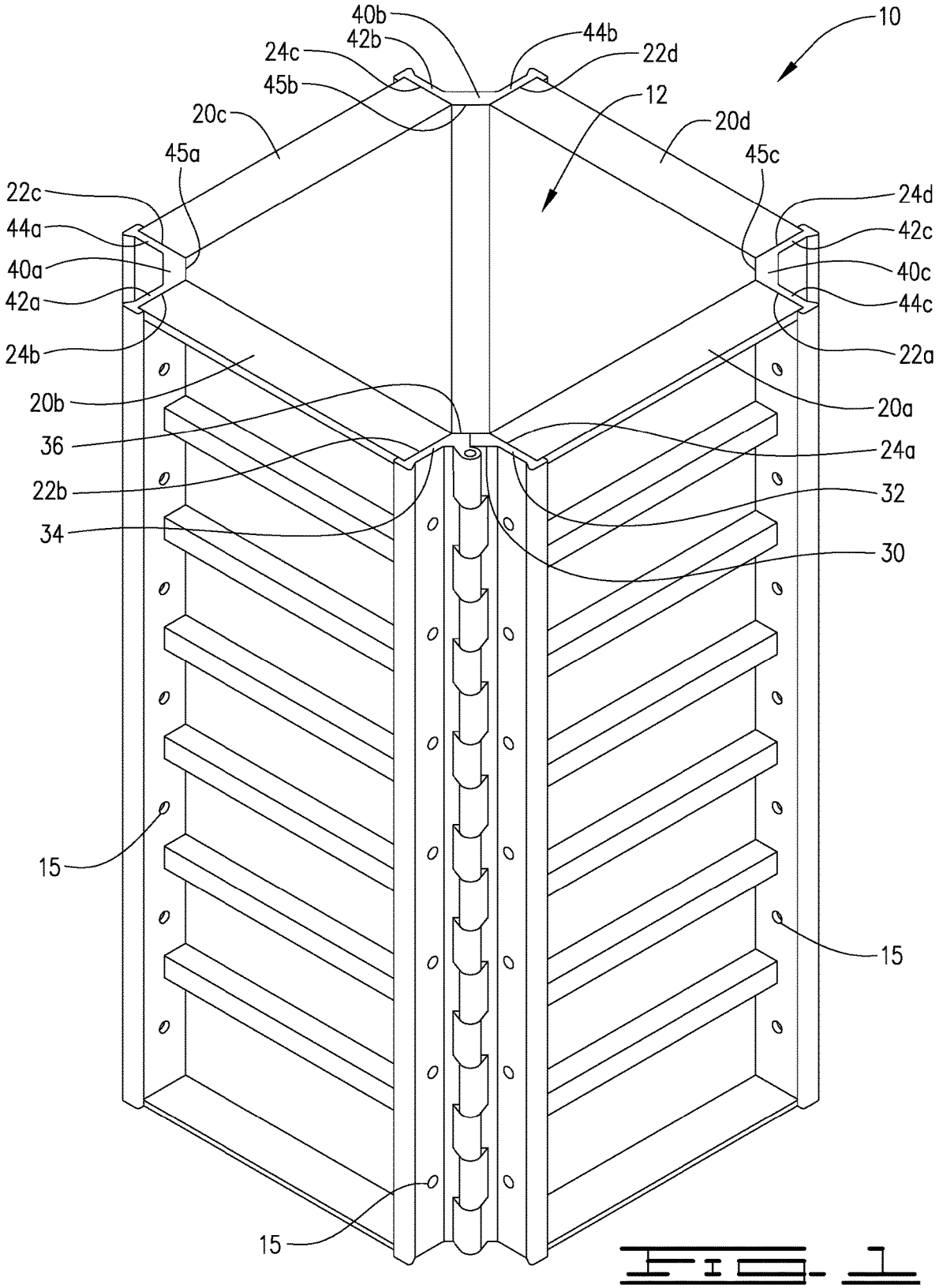
FIG. 1 is a perspective view of a column forming system with a hinge corner bracket in the closed position creating a closed system of the column forming system in accordance with one embodiment of the present disclosure.

The present disclosure may be understood more readily by reference to these detailed descriptions. For simplicity and clarity of illustration, where appropriate, reference numerals may be repeated among the different figures to indicate corresponding or analogous elements. In addition, numerous specific details are set forth in order to provide a thorough understanding of the various embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Referring now to FIGS. 1-8 generally, the column forming system of the present disclosure is illustrated and generally designated by the numeral 10. As shown by the drawings, the general form of column forming system 10 includes a first formwork panel 20*a* having a first edge 22*a* and second edge 24*a*, a second formwork panel 20*b* having a first edge 22*b* and a second edge 24*b*, a third formwork panel 20*c* having a first edge 22*c* and a second edge 24*c*, a fourth formwork panel 20*d* having a first edge 22*d* and a second edge 24*d*, a hinge corner bracket 30, a first corner bracket 40*a*, a second corner bracket 40*b*, and a third corner bracket 40*c*. Such configuration provides for a square column. However, one skilled in the art understands that the number of formwork panels and corner brackets can be adjusted based on the job application. For example, in some embodiments, column forming system 10 may include three formwork panels 20*a*, 20*b*, and 20*c*, hinge corner bracket 30, and two corner brackets 40*a*, 40*b*. Such configuration provides a triangular column. In some embodiments, the components of column forming system 10 are comprised of aluminum and/or steel.

Figure 2:
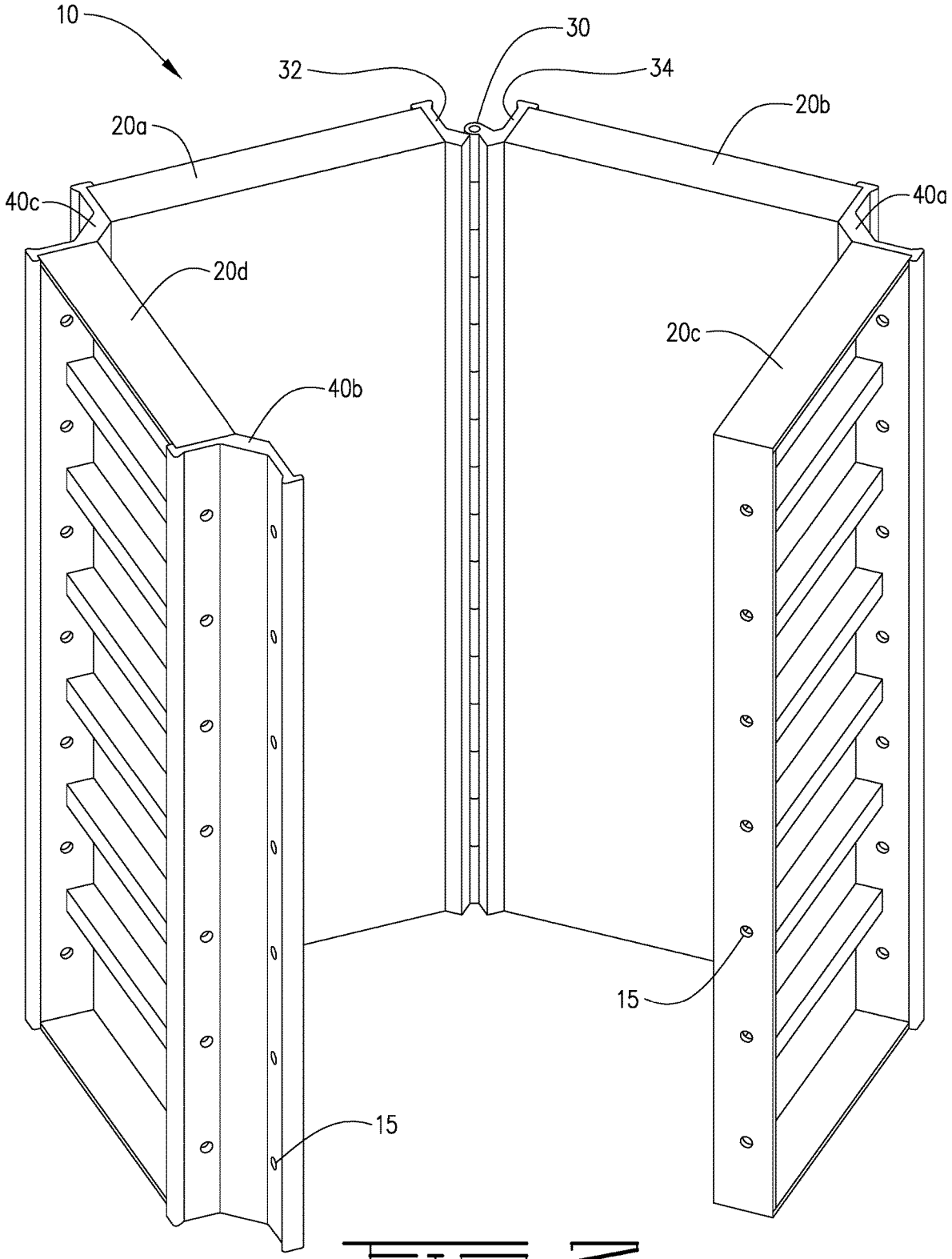
FIG. 2 is a perspective view of a column forming system with a hinge corner bracket in the open position allowing for manipulation of the formwork panels relative to one another in accordance with one embodiment of the present disclosure.
Figure 3:
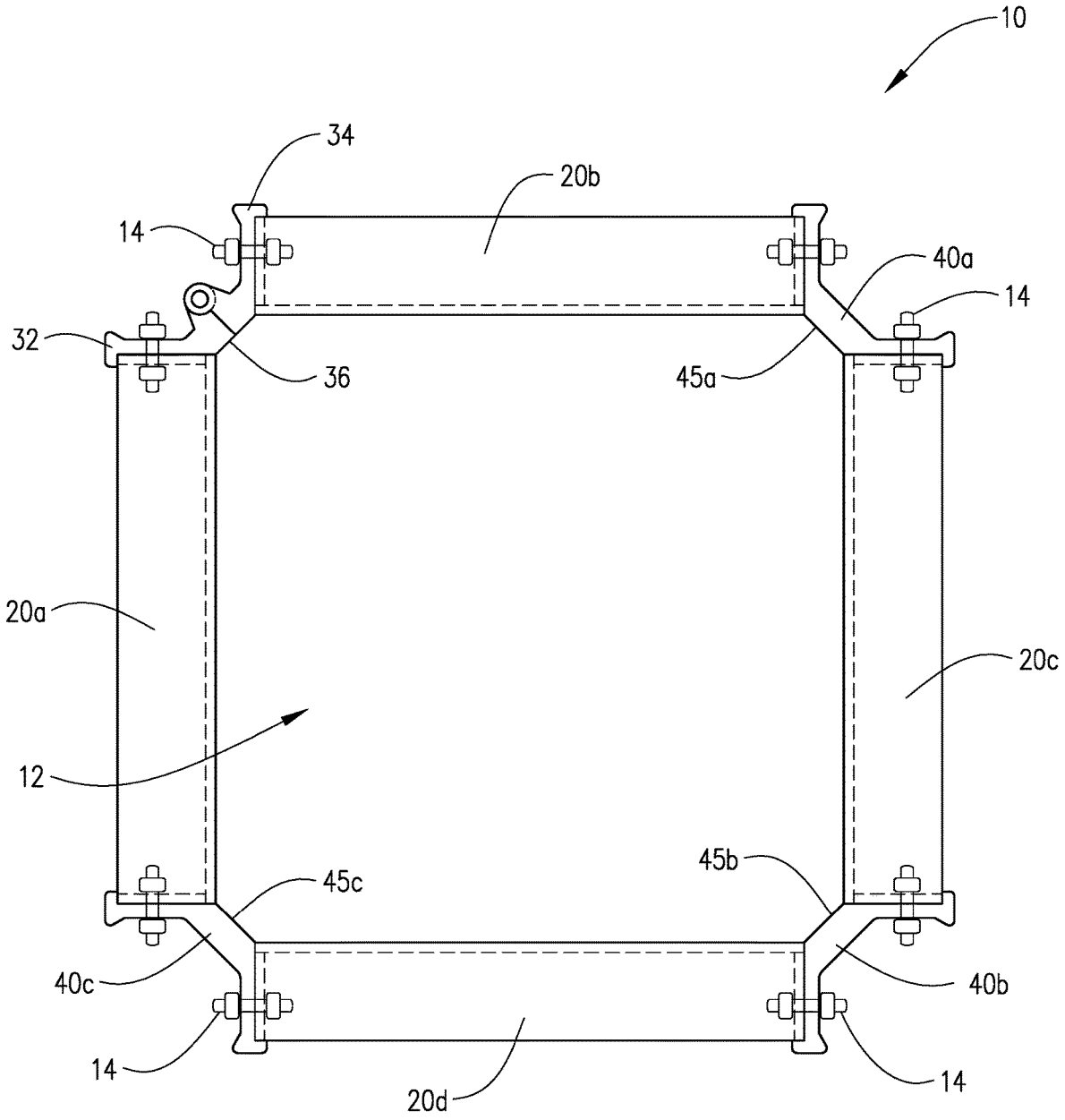
FIG. 3 is a top view of a column forming system with a hinge corner bracket in the closed position creating a closed system of the column forming system in accordance with one embodiment of the present disclosure.
Figure 4:
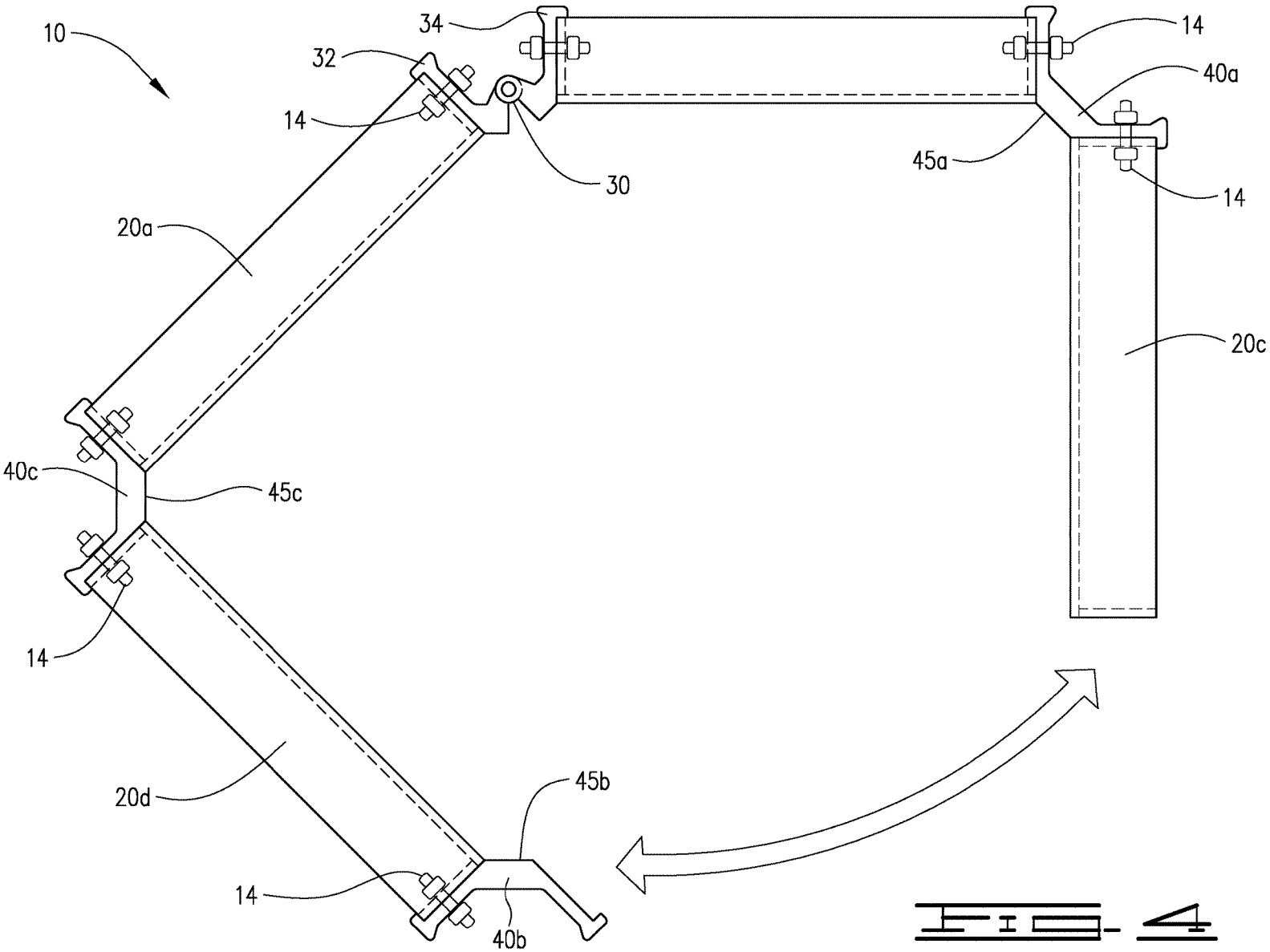
FIG. 4 is a top view of a column forming system with a hinge corner bracket in the open position allowing for manipulation of the formwork panels relative to one another in accordance with one embodiment of the present disclosure.
Figure 7A:
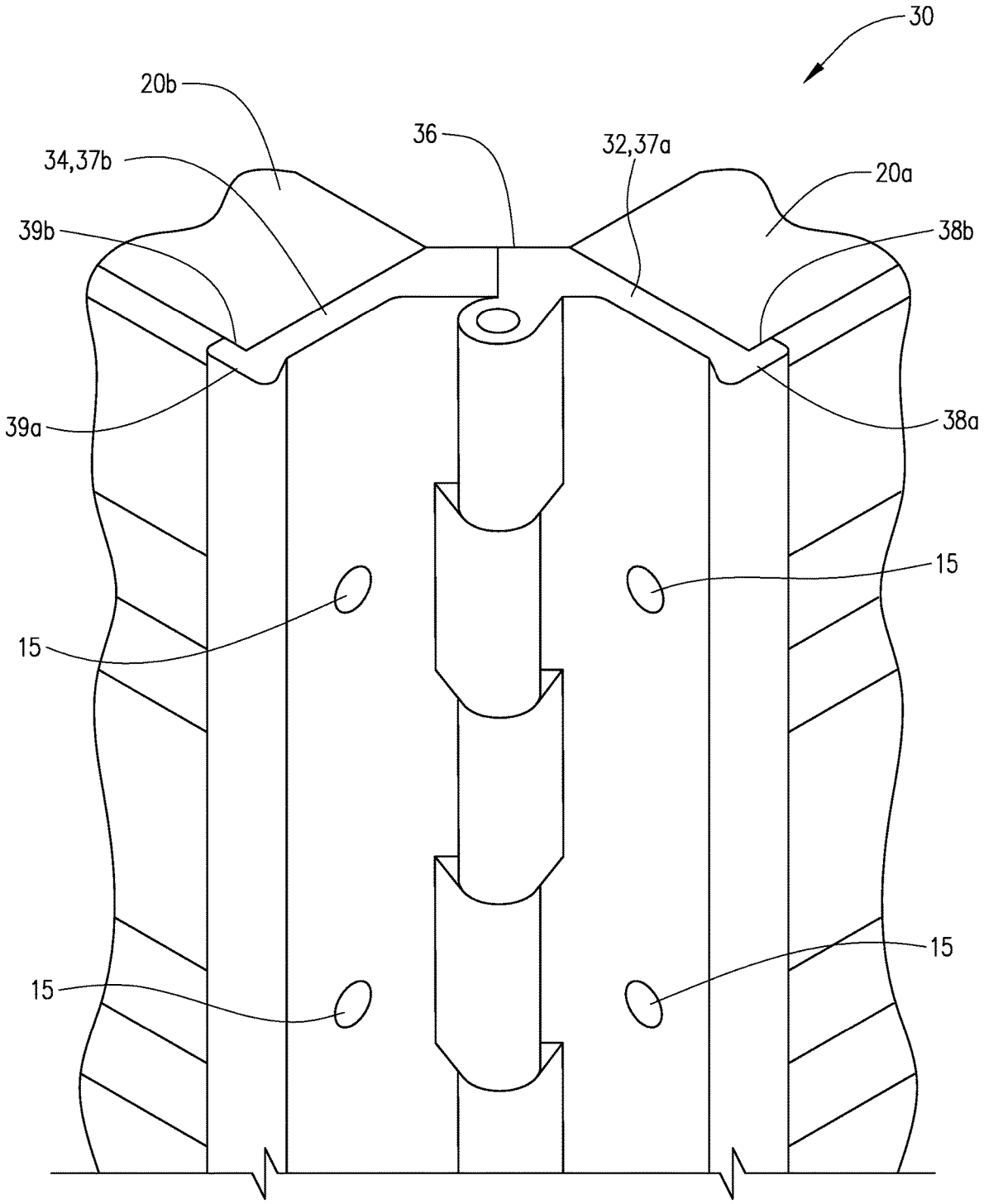
FIG. 7A is an enlarged perspective view of a hinge corner bracket in the closed position receiving two formwork panels in accordance with one embodiment of the present disclosure.
Figure 7B:
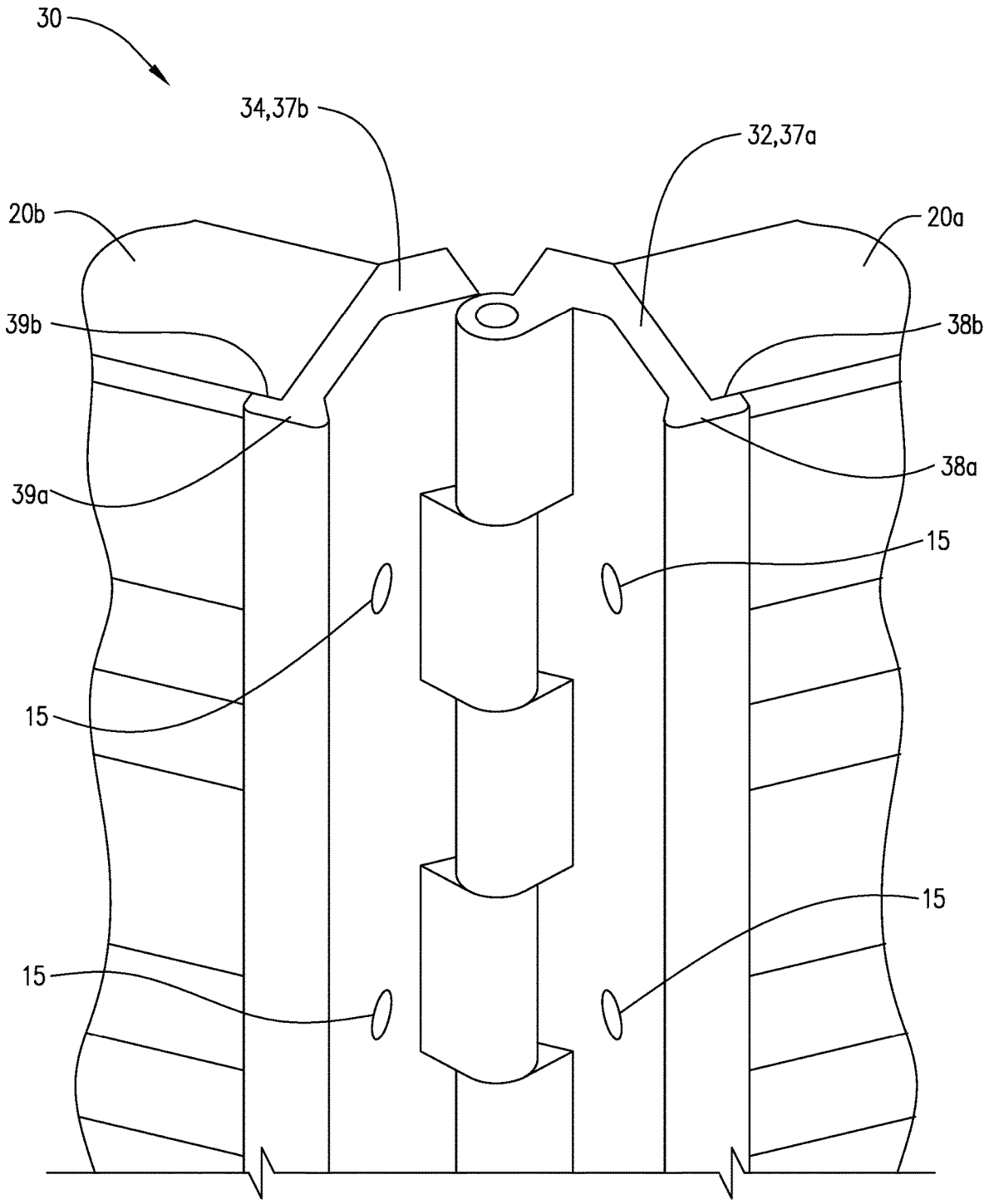
FIG. 7B is an enlarged perspective view of a hinge corner bracket in the open position receiving two formwork panels in accordance with one embodiment of the present disclosure.

Hinge corner bracket 30 includes a first rail 32 and a second rail 34 and is moveable between an open position and a closed position. In the open position, as shown by FIGS. 2, 4, and 7B, hinge corner bracket 30 allows manipulation of formwork panels 20*a*, 20*b*, 20*c*, and 20*d* relative to one another such that column forming system 10 can move from one column form location to the next. In the closed position, as shown by FIGS. 1, 3, and 7A, hinge corner bracket 30 forms a hinge chamfered panel 36 between two of formwork panels 20*a*, 20*b*, 20*c*, and 20*d*. The closed position defines a column interior 12 configured to receive a cementitious material for forming a column.

Figure 5A:
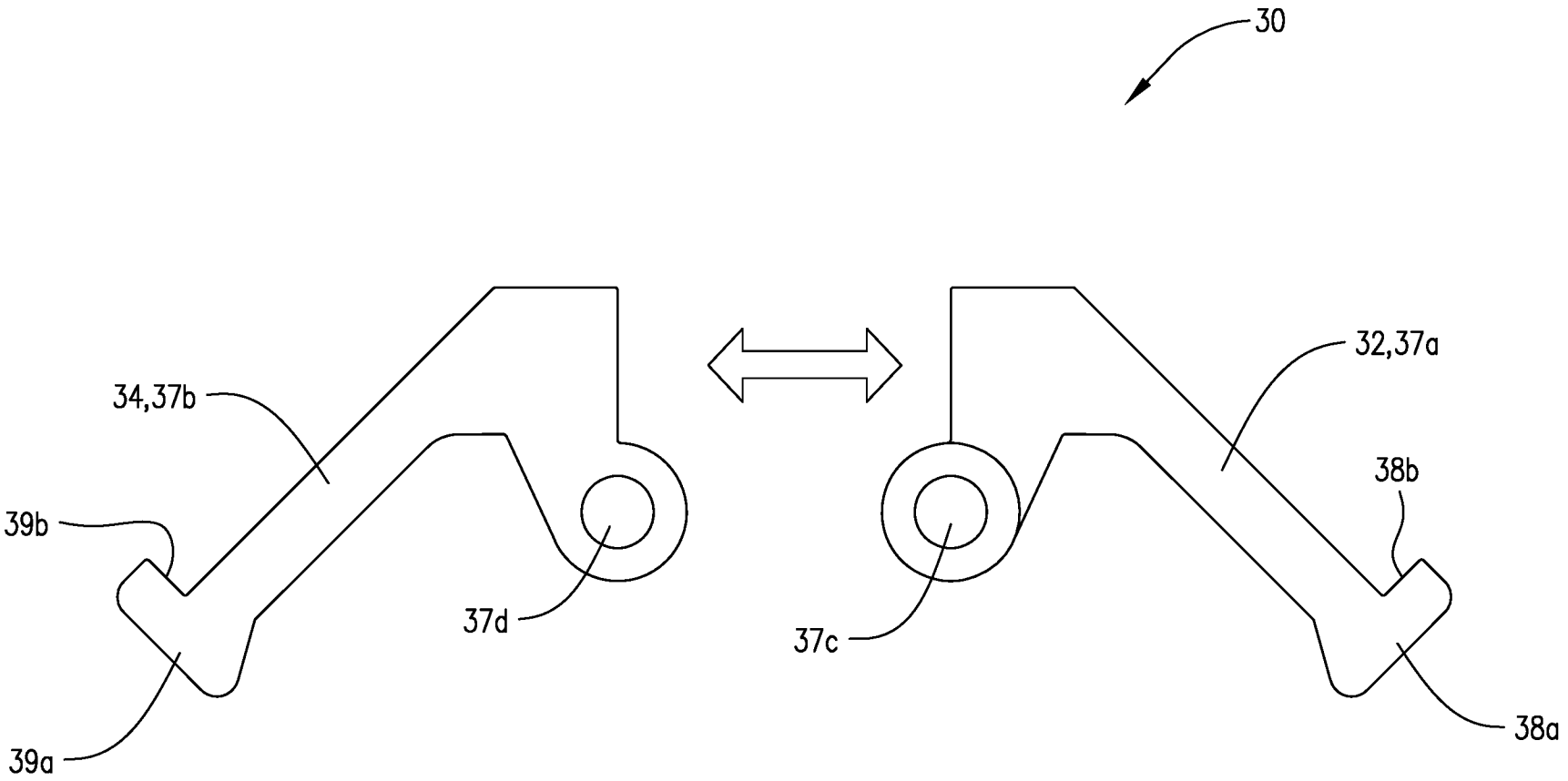
FIG. 5A is a top view of a hinge corner bracket prior to assembly in accordance with one embodiment of the present disclosure.
Figure 5B:
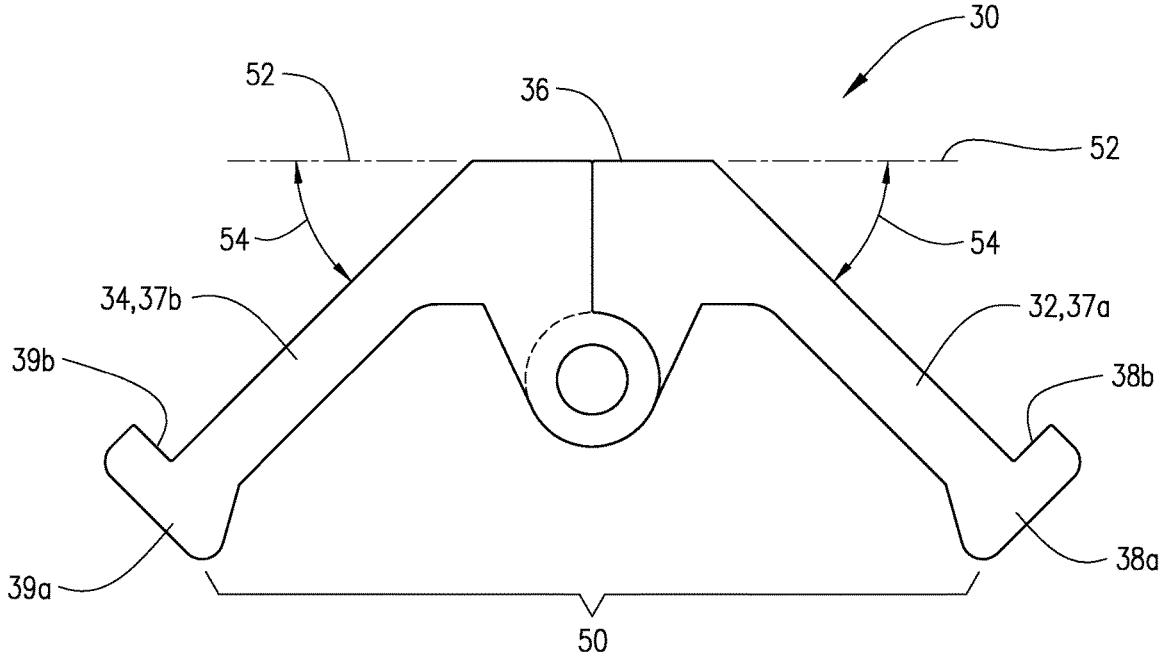
FIG. 5B is a top view of the hinge corner bracket of FIG. 5A assembled in accordance with one embodiment of the present disclosure.
Figure 5:
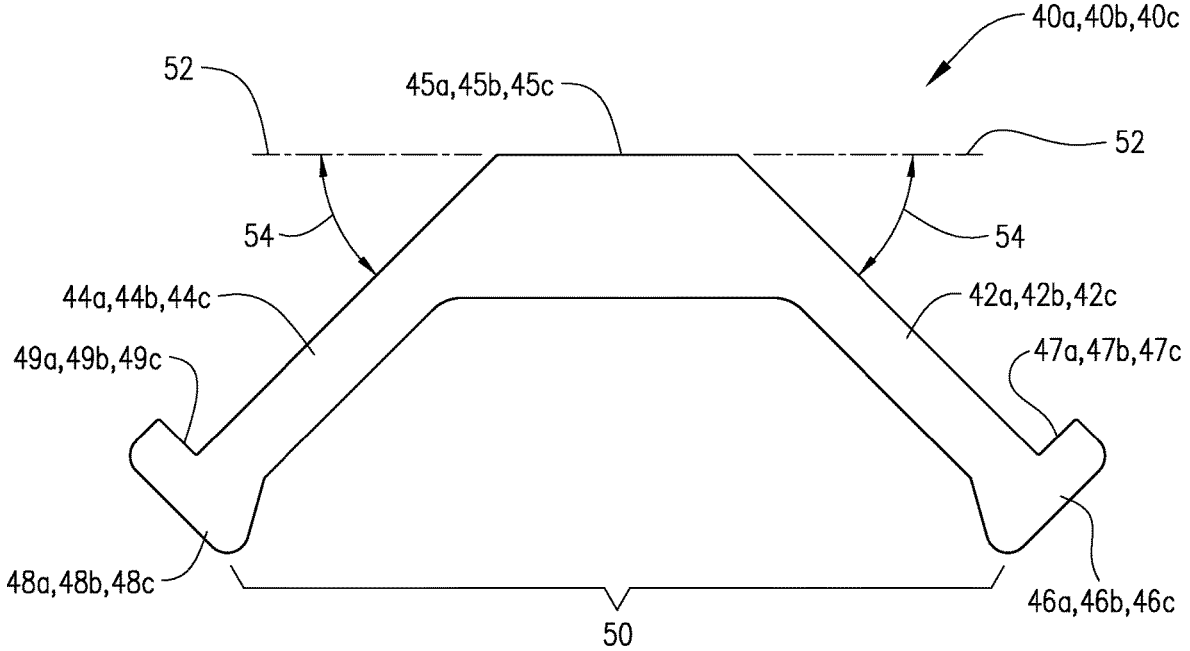
Figure 8:
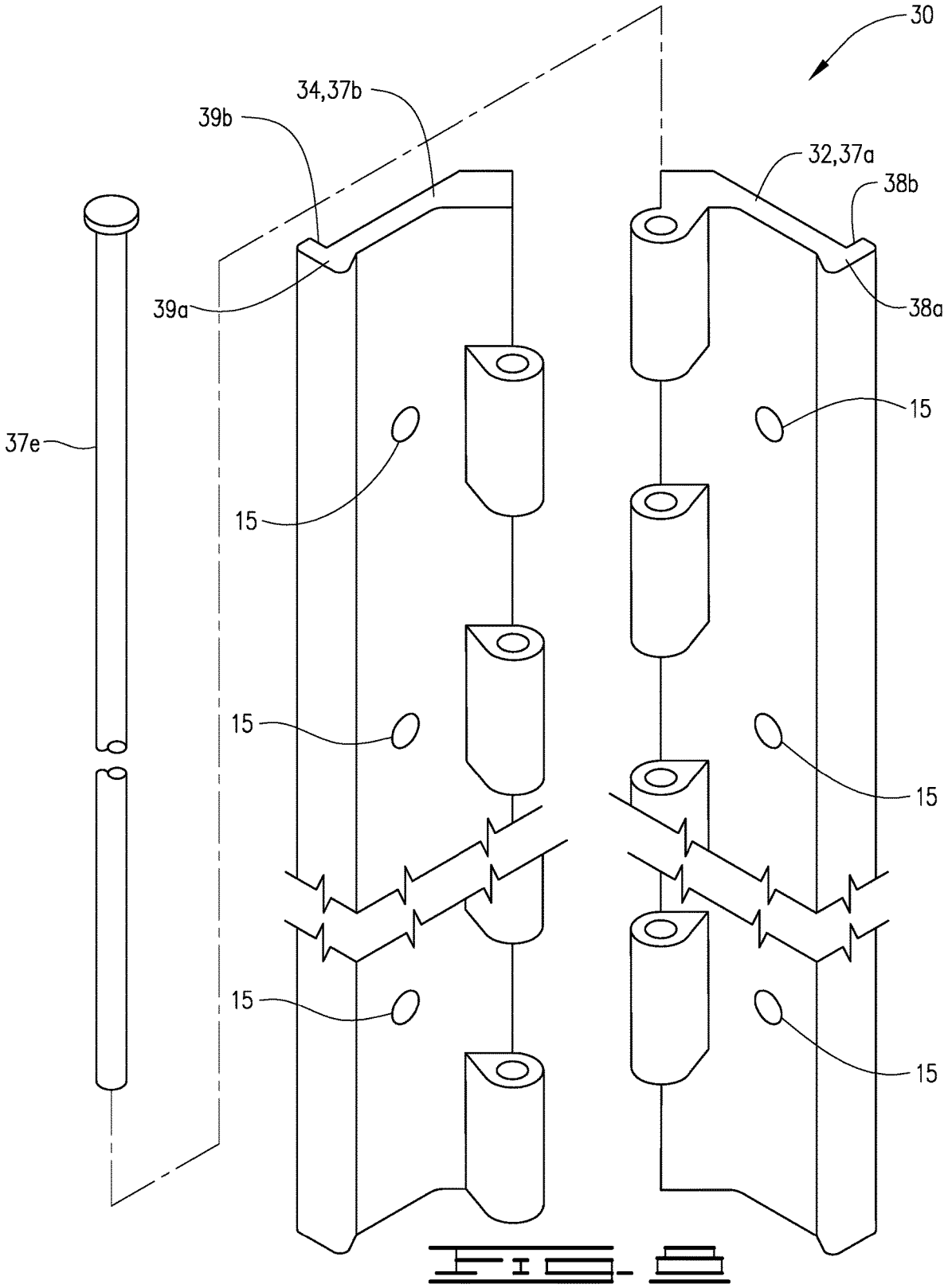
FIG. 8 is an enlarged perspective view of a hinge corner bracket prior to assembly in accordance with one embodiment of the present disclosure.

In some embodiments, as shown more specifically in FIGS. 5A, 5B, and 8, hinge chamfered panel 36 includes a first portion 37*a* and a second portion 37*b*. First portion 37*a* includes a portion of hinge chamfered panel 36, first rail 32, and a pivotal connection portion 37*c*. Second portion 37*b* includes a portion of hinge chamfered panel 36, second rail 34, and a pivotal connection portion 37*d*. When hinge corner bracket 30 is assembled, pivotal connection portions 37*c*, 37*d* interlock and align such that a rod 37*e* can be slid down through pivotal connection portions 37*c*, 37*d* to connection first portion 37*a* to second portion 37*b*. In some embodiments, first portion 37*a* is integrally formed with first rail 32. Second portion 37*b* is integrally formed with second rail 34. Integral formation of first portion 37*a* and second portion 37*b* allows manipulation of first portion 37*a* and second portion 37*b* relative to one another when hinge corner bracket 30 is moved between the open position and the closed position.

As shown more specifically by FIGS. 5B and 6, the top view of each of hinge corner bracket 30, when in the closed position, first corner bracket 40*a*, second corner bracket 40*b*, and third corner bracket 40*c* have a wing shape 50. Wing shape 50 is defined by a plane 52 that runs parallel to chamfered panels 36, 45*a*, 45*b*, 45*c* and a delta angle 54. Delta angle 54 is calculated as the degree of angle between horizontal plane 52 and first rails 32, 42*a*, 42*b*, and 42*c*, respectively, and horizontal plane 52 and second rails 34, 44*a*, 44*b*, and 44*c*, respectively. One skilled in the art understands delta angle 54 depends on the shape of the column desired and the number of formwork panels used in column forming system 10. While delta angle 54 may be any angle greater than 0° and less than 90°, delta angle 54 will more typically range from 15° to 85°. For example, delta angle 54 may range anywhere from 30° to 75°; however, more typically delta angle 54 will be 30°, 45° or 60° or within 5° of such angles.

Each of first corner bracket 40*a*, second corner bracket 40*b*, and third corner bracket 40*c* include a first rail 42*a*, 42*b*, 42*c*, a second rail 44*a*, 44*b*, 44*c*, and a chamfered panel 45*a*, 45*b*, 45*c*. In some embodiments, as more specifically shown in FIGS. 5A-8, each of hinge corner bracket 30, first corner bracket 40*a*, second corner bracket 40*b*, and third corner bracket 40*c* include a first end 38*a*, 46*a*, 46*b*, 46*c* and a second end 39*a*, 48*a*, 48*b*, 48*c*. Each of first end 38*a*, 46*a*, 46*b*, 46*c* includes a receiving lip 38*b*, 47*a*, 47*b*, 47*c*. Each of second end 39*a*, 48*a*, 48*b*, 48*c* includes a receiving lip 39*b*, 49*a*, 49*b*, 49*c*. Receiving lips 38*b*, 47*a*, 47*b*, 47*c* and 39*b*, 49*a*, 49*b*, 49*c* are configured to receive an edge 22*a*-*d*, 24*a*-*d* of formwork panels 20*a*-*d* and provide additional support to column forming system 10 as cementitious material is introduced into column interior 12.

Each of hinge corner bracket 30 and corner brackets 40*a*, 40*b*, 40*c* are removeable and replaceable. In some embodiments, hinge corner bracket 30 and corner brackets 40*a*, 40*b*, 40*c* are removeable and replaceable with an attachment system 14 configured to connect hinge corner bracket 30 and corner brackets 40*a*, 40*b*, 40*c* to formwork panels 20*a*, 20*b*, 20*c*, 20*d*. As shown in FIGS. 3 and 4, attachment system 14 is nuts and bolts, where the bolts slide through a number of apertures 15 in first rails 32, 42*a*, 42*b*, 42*c* and second rails 34, 44*a*, 44*b*, 44*c*. In other embodiments, attachment system 14 is wedge bolts or clamps. Once attachment systems 14 are secured, and hinge corner bracket 30 is in the closed position, column forming system 10 is a closed system defining column interior 12 such that cementitious material can be introduced to form a column.

A method of forming a concrete column with column forming system 10 will now be described with reference generally to FIGS. 1-8. For ease of reference, the method will be described in accordance with forming a square column with chamfered corners. However, one skilled in the art understands such method can be used with more or less formwork panels to create the desired shape of the column provide one of the corner brackets is hinge corner bracket 30.

The initial assembly step requires attaching first rail 32 of hinge corner bracket 30 to second edge 24*a* of first formwork panel 20*a*, where hinge corner bracket 30 is moveable between the open position and the closed position. Second rail 34 of hinge corner bracket 30 is then attached to first edge 22*b* of second formwork panel 20*b* such that, when hinge corner bracket 30 is in the closed position, hinge chamfered panel 36 extends between first formwork panel 20*a* and second formwork panel 20*b*. After attaching hinge corner bracket 30 to formwork panels 20*a*, 20*b*, the following attachment steps are performed: (i) first rail 42*a* of first corner bracket 40*a* is attached to second edge 24*b* of second formwork panel 20*b*; (ii) second rail 44*a* of first corner bracket 40*a* is attached to first edge 22*c* of third formwork panel 20*c* such that chamfered panel 45*a* extends between second formwork panel 20*b* and third formwork panel 20*c*; (iii) first rail 42*b* of second corner bracket 40*b* is attached to second edge 24*c* of third formwork panel 20*c*; (iv) second rail 44*b* of second corner bracket 40*b* is attached to first edge 22*d* of fourth formwork panel 20*d* such that second chamfered panel 45*b* extends between third formwork panel 20*c* and fourth formwork panel 20*d*; (v) first rail 42*c* of third corner bracket 40*c* is attached to second edge 24*d* of fourth formwork panel 20*d*; (vi) second rail 44*c* of third corner bracket 40*c* is attached to first edge 22*a* of first formwork panel 20*a* such that third chamfered panel 45*c* extends between fourth formwork panel 20*d* and first formwork panel 20*a*.

Prior to step (vi) of the attachment steps, hinge corner bracket 30 is moved into the closed position such that step (vi) creates a closed system of column forming system 10 defining column interior 12. While described with the above specific order, with step (vi) being the last step, those skilled in the art will realize that the method of forming a concrete column with column forming system 10 can use a different order for the attachment steps. For example, step (vi) can occur before moving hinge corner bracket 30 into the closed position, and attachment steps (i), (ii), (iii), (iv), or (v) can be the final attachment step after moving hinge corner bracket 30 into the closed position.

After creating the closed system of column forming system 10, cementitious material is introduced into column interior 12. The cementitious material is then given a sufficient time period to cure to create a cementitious column. After sufficient time to cure has passed, one of either first rail 42*a*, 42*b*, 42*c* or second rail 44*a*, 44*b*, 44*c* of one of corner brackets 40*a*, 40*b*, 40*c* is detached. In some embodiments, the corner bracket 40*a*, 40*b*, 40*c* directly opposite hinge corner bracket 30 will be selected for detachment in the step of detaching one of either first rail 42*a*, 42*b*, 42*c* or second rail 44*a*, 44*b*, 44*c* of one of corner brackets 40*a*, 40*b*, 40*c*. For example, as shown in FIGS. 1, 2 and 4, one of either first rail 42*b* or second rail 44*b* of second corner bracket 40*b* is detached. Hinge corner bracket 30 is then moved into the open position to allow manipulation of formwork panels 20*a*, 20*b*, 20*c*, 20*d* relative to one another. Once hinge corner bracket 30 is in the open position, formwork panels 20*a*, 20*b*, 20*c*, 20*d* are manipulated relative to one another such that column forming system 10 is removed to expose the cementitious column and move column forming system 10 to the next location.

Therefore, the present disclosure is well adapted to attain the ends and advantages mentioned, as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present disclosure. While apparatus and methods may be described in terms of "comprising," "containing," "having," or "including" various components or steps, the apparatus and methods can also, in some examples, "consist essentially of" or "consist of" the various components and steps. Also, the terms in the claims have their plain, ordinary meaning unless otherwise explicitly and clearly defined by the specification.

What is claimed is:

1. A column forming system comprising:

a first formwork panel having a first edge and a second edge;

a second formwork panel having a third edge and a fourth edge;

a third formwork panel having a fifth edge and a six edge;

a hinge corner bracket moveable between an open position and a closed position, the hinge corner bracket having a first rail and a second rail, wherein the first rail of the hinge corner bracket is attached to the second edge of the first formwork panel and the second rail of the hinge corner bracket is attached to the third edge of the second formwork panel, and wherein in the closed position the hinge corner bracket forms a hinge chamfered panel extending between the first formwork panel and the second formwork panel;

a first corner bracket having a third rail, a fourth rail, and a first chamfered panel extending between the third rail and the fourth rail, wherein the third rail of the first corner bracket is attached to the fourth edge of the second formwork panel and the fourth rail of the first corner bracket is attached to the fifth edge of the third formwork panel such that the first chamfered panel extends between the second formwork panel and the third formwork panel; and a second corner bracket having a fifth rail, a sixth rail, and a second chamfered panel extending between the fifth rail and the sixth rail, wherein the fifth rail of the second corner bracket is attached to the sixth edge of the third formwork panel;

wherein the open position of the hinge corner bracket is configured to allow manipulation of the first formwork panel, the second formwork panel, and the third formwork panel relative to one another; and wherein in the closed position of the hinge corner bracket, the column forming system defines a column interior; and wherein each of the first rail and the second rail of the hinge corner bracket, the third rail and the fourth rail of the first corner bracket, and the fifth rail and the sixth rail of the second corner bracket extend from the hinge chamfered panel, the first chamfered panel, or the second chamfered panel, respectively, to form a wing shape.

2. The column forming system of claim 1, wherein the hinge corner bracket further comprises:

a first portion of the hinge chamfered panel is integrally formed with the first rail of the hinge corner bracket;

a second portion of the hinge chamfered panel is integrally formed with the second rail of the hinge corner bracket, wherein the first portion and the second portion are pivotally connected;

wherein in the closed position, the first portion and the second portion form the hinged chamfered panel extending between the first formwork panel and the second formwork panel; and wherein the open position of the hinge corner bracket is configured to allow manipulation of the first portion and the second portion relative to one another.

3. The column forming system of claim 1, wherein each of the hinge corner bracket, the first corner bracket, and the second corner bracket are removable and replaceable.

4. The column forming system of claim 3, wherein each of the hinge corner bracket, the first corner bracket, and the second corner bracket are removable and replaceable with an attachment system selected from the group consisting of wedge bolts, nuts and bolts, and clamps.

5. The column forming system of claim 4, wherein each of the first rail and the second rail of the hinge corner bracket, the third rail and the fourth rail of the first corner bracket, and the fifth rail and the sixth rail of the second corner bracket include apertures for connection of the attachment system.

6. The column forming system of claim 1, wherein the sixth rail of the second corner bracket is attached to the first edge of the first formwork panel such that the second chamfered panel extends between the third formwork panel and the first formwork panel to create a closed system of the column forming system.

7. The column forming system of claim 1, wherein each of the hinge corner bracket, the first corner bracket, and the second corner bracket further comprise:

a first end having a first receiving lip;

a second end having a second receiving lip, wherein the first receiving lip and the second receiving lip are configured to receive either the first edge or the second edge of the first formwork panel, the first edge or the second edge of the second formwork panel, or the first edge or the second edge of the third formwork panel.

8. The column forming system of claim 1, wherein the wing shape is formed by each of the first rail and the second rail of the hinge corner bracket, the third rail and the fourth rail of the first corner bracket, and the fifth rail and the second sixth rail of the second corner bracket having a delta angle of about 30 degrees to about 75 degrees.

9. The column forming system of claim 1 further comprising:

a fourth formwork panel having a seventh edge and eighth edge;

wherein the sixth rail of the second corner bracket is attached to the seventh edge of the fourth formwork panel such that the second chamfered panel extends between the third formwork panel and the fourth formwork panel; and a third corner bracket having a seventh rail, a eighth rail, and a third chamfered panel extending between the seventh rail and the eighth rail, wherein the seventh rail of the third corner bracket is attached to the eighth edge of the fourth formwork panel;

wherein the open position of the hinge corner bracket is configured to allow manipulation of the first formwork panel, the second formwork panel, the third formwork panel, and the fourth formwork panel relative to one another.

10. The column forming system of claim 9, wherein the hinge corner bracket further comprises:

a first portion of the hinge chamfered panel is integrally formed with the first rail of the hinge corner bracket;

a second portion of the hinge chamfered panel is integrally formed with the second rail of the hinge corner bracket, wherein the first portion and the second portion are pivotally connected;

wherein in the closed position, the first portion and the second portion form the hinged chamfered panel extending between the first formwork panel and the second formwork panel; and wherein the open position of the hinge corner bracket is configured to allow manipulation of the first portion and the second portion relative to one another.

11. The column forming system of claim 9, wherein each of the hinge corner bracket, the first corner bracket, and the second corner bracket are removable and replaceable with an attachment system selected from the group consisting of wedge bolts, nuts and bolts, and clamps.

12. The column forming system of claim 9, wherein the eighth rail of the third corner bracket is attached to the first edge of the first formwork panel such that the third chamfered panel extends between the fourth formwork panel and the first formwork panel to create a closed system of the column forming system.

13. The column forming system of claim 9, wherein each of the hinge corner bracket, the first corner bracket, the second corner bracket, and the third corner bracket further comprise:

a first end having a first receiving lip;

a second end having a second receiving lip, wherein the first receiving lip and the second receiving lip are configured to receive either the first edge or the second edge of the first formwork panel, the third edge or the fourth edge of the second formwork panel, the fifth edge or the sixth edge of the third formwork panel, or the seventh edge or the second eighth edge of the fourth formwork panel.

14. The column forming system of claim 9, the wing shape has a delta angle of about 30 degrees to about 75 degrees.

15. The column forming system of claim 9, wherein in the open position, one of either the fifth rail or the sixth rail of the second corner bracket is detached to allow manipulation of the first formwork panel, the second formwork panel, the third formwork panel, and the fourth formwork panel relative to one another.

16. The column forming system of claim 1, wherein the first formwork panel, the second formwork panel, the third formwork panel, the hinge corner bracket, the first corner bracket, and the second corner bracket are comprised of a material selected from the group consisting of aluminum and steel.

17. A column forming system comprising:

a first formwork panel having a first edge and a second edge;

a second formwork panel having a third edge and a fourth edge;

a third formwork panel having a fifth edge and a six edge;

a hinge corner bracket moveable between an open position and a closed position, the hinge corner bracket having a first rail and a second rail, wherein the first rail of the hinge corner bracket is attached to the second edge of the first formwork panel and the second rail of the hinge corner bracket is attached to the third edge of the second formwork panel, and wherein in the closed position the hinge corner bracket forms a hinge chamfered panel extending between the first formwork panel and the second formwork panel;

a first corner bracket having a third rail, a fourth rail, and a first chamfered panel extending between the third rail and the fourth rail, wherein the third rail of the first corner bracket is attached to the fourth edge of the second formwork panel and the fourth rail of the first corner bracket is attached to the fifth edge of the third formwork panel such that the first chamfered panel extends between the second formwork panel and the third formwork panel; and a second corner bracket having a fifth rail, a sixth rail, and a second chamfered panel extending between the fifth rail and the sixth rail, wherein the fifth rail of the second corner bracket is attached to the sixth edge of the third formwork panel;

wherein the open position of the hinge corner bracket is configured to allow manipulation of the first formwork panel, the second formwork panel, and the third formwork panel relative to one another; and wherein in the closed position of the hinge corner bracket, the column forming system defines a column interior; and wherein the hinge corner bracket further comprises:

a first portion of the hinge chamfered panel is integrally formed with the first rail of the hinge corner bracket;

a second portion of the hinge chamfered panel is integrally formed with the second rail of the hinge corner bracket, wherein the first portion and the second portion are pivotally connected;

wherein in the closed position, the first portion and the second portion form the hinged chamfered panel extending between the first formwork panel and the second formwork panel; and wherein the open position of the hinge corner bracket is configured to allow manipulation of the first portion and the second portion relative to one another.

18. A column forming system comprising:

a first formwork panel having a first edge and a second edge;

a second formwork panel having a third edge and a fourth edge;

a third formwork panel having a fifth edge and a six edge; and a fourth formwork panel having a seventh edge and eighth edge;

a hinge corner bracket moveable between an open position and a closed position, the hinge corner bracket having a first rail and a second rail, wherein the first rail of the hinge corner bracket is attached to the second edge of the first formwork panel and the second rail of the hinge corner bracket is attached to the third edge of the second formwork panel, and wherein in the closed position the hinge corner bracket forms a hinge chamfered panel extending between the first formwork panel and the second formwork panel;

a first corner bracket having a third rail, a fourth rail, and a first chamfered panel extending between the third rail and the fourth rail, wherein the third rail of the first corner bracket is attached to the fourth edge of the second formwork panel and the fourth rail of the first corner bracket is attached to the fifth edge of the third formwork panel such that the first chamfered panel extends between the second formwork panel and the third formwork panel; and a second corner bracket having a fifth rail, a sixth rail, and a second chamfered panel extending between the fifth rail and the sixth rail, wherein the fifth rail of the second corner bracket is attached to the sixth edge of the third formwork panel, wherein the sixth rail of the second corner bracket is attached to the seventh edge of the fourth formwork panel such that the second chamfered panel extends between the third formwork panel and the fourth formwork panel; and a third corner bracket having a seventh rail, a eighth rail, and a third chamfered panel extending between the seventh rail and the eighth rail, wherein the seventh rail of the third corner bracket is attached to the eighth edge of the fourth formwork panel;

wherein the open position of the hinge corner bracket is configured to allow manipulation of the first formwork panel, the second formwork panel, the third formwork panel, and the fourth formwork panel relative to one another; and wherein in the closed position of the hinge corner bracket, the column forming system defines a column interior; and wherein the hinge corner bracket further comprises:

a first portion of the hinge chamfered panel is integrally formed with the first rail of the hinge corner bracket;

a second portion of the hinge chamfered panel is integrally formed with the second rail of the hinge corner bracket, wherein the first portion and the second portion are pivotally connected;

wherein in the closed position, the first portion and the second portion form the hinged chamfered panel extending between the first formwork panel and the second formwork panel; and wherein the open position of the hinge corner bracket is configured to allow manipulation of the first portion and the second portion relative to one another.

* * * * *